US005251499A

United States Patent [19]

Isozumi

[11] Patent Number: 5,251,499

[45] Date of Patent: Oct. 12, 1993

[54] INTERMEDIATE GEAR TYPE STARTER MOTOR

[75] Inventor: Shuzou Isozumi, Hyogo, Japan

[73] Assignee: Mitsubishi Denki K.K., Tokyo, Japan

[21] Appl. No.: 881,660

[22] Filed: May 12, 1992

[30] Foreign Application Priority Data

May 13, 1991 [JP] Japan ..... 3-43194[U]

[51] Int. Cl.[5] ..... F02N 15/06

[52] U.S. Cl. ..... 74/7 E; 74/7 A

[58] Field of Search ..... 74/7 A, 7 E

[56] References Cited

U.S. PATENT DOCUMENTS 4,970,908 11/1990 Isozumi et al. ..... 74/7 E
4,974,463 12/1990 Luiki ..... 74/7 E X
5,130,586 7/1992 Miyagi ..... 74/7 E

*Primary Examiner*—Allan D. Herrmann
*Attorney, Agent, or Firm*—Sughrue, Mion, Zinn, Macpeak & Seas

[57] ABSTRACT

In order to provide a starter motor with an intermediate gear which can secure a good engaging performance for a pinion, an intermediate gear and a ring gear to thereby eliminate the strange sound of the intermediate gear and to reduce the wear of a bearing of the intermediate gear as well as the wear of the teeth of the pinion and intermediate gear, according to the invention, there is provided a starter motor with an intermediate gear in which the shift coefficient of a pinion is set smaller than the shift coefficient of the intermediate gear to thereby reduce a difference between two kinds of engagement pressure angles respectively obtained between the pinion and intermediate gear as well as between the intermediate gear and a ring gear.

2 Claims, 4 Drawing Sheets

$\alpha_{b1}$ : AN ENGAGEMENT PRESSURE ANGLE BETWEEN THE PINION AND INTERMEDIATE GEAR $\alpha_{b2}$ : AN ENGAGEMENT PRESSURE ANGLE BETWEEN THE INTERMEDIATE GEAR AND RING GEAR

INTERMEDIATE GEAR TYPE STARTER MOTOR

BACKGROUND OF THE INVENTION

1. Field of the Invention

This invention relates to a starter motor with an intermediate gear in which the rotation of a pinion disposed externally of a clutch inner of an overrunning clutch mounted on an output shaft of the starter motor is reduced and transmitted through an intermediate gear to a ring gear.

2. Description of the Prior Art

In FIG. 2, there is shown a section view of a conventional starter motor with an intermediate gear. In this figure, reference numeral 1 designates a DC motor which comprises a stator 2 and an armature 3. 4 stands for an output shaft which is an extension of an output shaft of the armature 3, and 5 points out a front bracket which is coupled to the stator 2 by means of a bolt and supports the front end portion of the output shaft 4 through a bearing 6. 7 designates an end cover. 8 stands for an overrunning clutch which is mounted to the output shaft 4 and constructed in the following manner: that is, the overrunning clutch 8 includes a clutch outer member 9 coupled to the output shaft 4 through a helical spline 11, and a clutch inner member 10 which transmits rotation to the clutch outer member 9 in one way through a roller 12. The clutch inner member 10 includes a pinion 13 in the front end portion thereof. The clutch inner member 10 is supported by the output shaft 4 through a bearing 15, and is slidable in the axial direction thereof.

16 designates a stopper which is fixed to the output shaft 4 and is used to receive the advancing movement of the overrunning clutch 8 at a given position. 17 stands for a shift lever which is rotatably supported in the intermediate portion thereof by the front bracket 5, with the upper end portion of the shift lever 17 in engagement with a plunger (not shown) of an electromagnetic switch. The shift lever 17 also includes a forked portion the lower end portion of which is in axial engagement with an annular engaging portion 14 of the clutch outer member 9. When the electromagnetic switch is electrically energized, the shift lever 17 is rotated counterclockwise in FIG. 2 to thereby move the overrunning clutch 8 forwardly. When the electromagnetic switch is cut off, then the shift lever 17 is moved or returned clockwise in FIG. 2 to thereby move backwardly or return the overrunning clutch 8 to its original position.

18 designates an intermediate gear shaft fixed to the front bracket and 19 stands for an intermediate gear which is supported rotatably and axially movably by the intermediate gear shaft 18 through a bearing 20. The intermediate gear 19 is always in mesh with the pinion 13 and is rotatable reducingly. 21 points out an annular linking member which is fixedly secured to the outer peripheries of the clutch outer member 9 and includes a flange portion 21*a* in engagement with an annular groove 19*a* formed in the intermediate gear 19. The annular linking member 21 moves the intermediate gear 19 in link with the forward or rearward movement of the overrunning clutch 8. 25 designates a ring gear disposed on a flywheel of an engine. The ring gear 25 is engageable with the intermediate gear 19 when the latter is moved forwardly, so that the ring gear 25 can be started and rotated.

Next, description will be given below of the engagement and shift of a set of gears with reference to FIG. 4 in which a tooth 30*a* of a small gear 30 is in mesh or engagement with a tooth 31*a* of a large gear 31.

Assuming that m=a module, Z=the number of teeth; dp=Z×m=pitch diameter; X=a shift coefficient; Xm=an amount of shift; $\alpha c$=a tool pressure angle; dg=a base circle diameter; a=a center distance; Cn=a backlash; and $\alpha b$=an engaging pressure angle, then the following equation can be obtained.

$$\cos\alpha b=(dp_1+dp_2)\cdot\cos\alpha c/(2a) \quad (1)$$

Profile shifted gears are gears which are formed by shifting the standard pitch line (a pitch line for which the tooth thickness is one half of a pitch) of a rack tool in the radial direction from the standard pitch circle radii ($r_0=d_p/2=Zm/2$) of the gears. This can be accomplished by cutting the teeth of a gear with an enlarged or reduced outside diameter, thereby increasing or decreasing the tooth thickness, respectively. In standard gears, when the number of teeth is small, then undercutting occurs to reduce the value of the meshing or action rate of the gears. That is, in the set of gears, the teeth of the small gear is weaker in strength than those of the large gear. For this reason, if the gears are formed as the profile shifted gears, then various kinds of requirements can be satisfied. For example, the undercutting can be prevented according to the designs of the gears by use of a standard tool, the tooth thickness and center distance of the gears can be varied, and so on. The degree by how much tooth thickness is varied is the shift coefficient. The higher the shift coefficient, the greater the tooth thickness, and accordingly, the greater the strength of the teeth.

In a gear arrangement in which a pair of gears are included, the number of teeth increases sequentially in the order of the pinion 13, intermediate gear 18 and ring gear 25. For this reason, in view of the gear strength, conventionally, the pinion 13 is given the greatest shift coefficient, the intermediate gear 18 the intermediate shift coefficient, and the ring gear 25 the smallest shift coefficient.

Now, description will be given below of the engagement relations among the pinion 13, intermediate gear 18 and ring gear 25 employed in a conventional intermediate gear type starter motor with reference to FIG. 3(A).

Assuming that $\alpha b_1$=an engaging pressure angle between the pinion 13 and intermediate gear 19, and $\alpha b_2$=an engaging pressure angle between the intermediate gear 19 and ring gear 25, then the shift coefficient x of the pinion>the shift coefficient x of the intermediate gear>the shift coefficient x of the ring gear. Thus, $\alpha b_1$ is considerably greater than $\alpha b_2$. If a difference between $\alpha b_1$ and $\alpha b_2$ is great, then the intermediate gear 19 is given pressure and is drawn to one side due to the difference between the two angles, thereby worsening the engagements therebetween, as shown in FIG. 3(B). In FIG. 3(B), $F_1$ expresses an action force to be given to the intermediate gear 19 by the pinion 13, $F_2$ stands for a reaction force to be produced in the pinion 13 from the intermediate gear 19, $F_3$ points out an action force to be given to the ring gear 25 by the intermediate gear 19, and $F_4$ designates a reaction force to be produced in the intermediate gear 19 from the ring gear 25. While the respective forces are all equal, the engaging pressure angles $\alpha b$ are different. Also, an engagement efficiency obtained between the pinion 13 and intermediate gear 19 is worsened (because the engaging pressure angle $\alpha b$ is great). When the state of FIG. 3(B) is viewed from the whole intermediate gear 19, then the component of a composite force P produced by $F_1$ and $F_4$ becomes greater, resulting in the biased engagement, as shown in FIG. 3(C). o Here, description will be given of an engagement coefficient between a pair of gears with reference to FIG. 5. The term "engagement coefficient" means that pieces of teeth are engaged when a pair of gears are in engagement with each other. The engagement coefficient $\epsilon$=the engagement length/the normal pitch. As the engagement coefficient varies, the loads to be applied to the teeth of the gears are caused to vary. In theory, when the engagemcnt coefficient is equal to 1 or less, then the gears cannot be rotated in a normal condition. The engagement coefficient $\epsilon$ is expressed by an expression (2) of a numerical representation 1. Assume that dg=bottom land circle diameter, and dk=tooth crest circle diameter.

[Numerical Representation 1]

$$\text{Engagement Coefficient } (\epsilon) = \frac{\overline{ST}}{\text{Normal Pitch}(te)} = \frac{\overline{ST}}{\pi m \cos\alpha_b}$$

$$ST = \sqrt{(\overline{O_1S})^2 - (\overline{O_1N})^2} + \sqrt{(\overline{O_1T})^2 - (\overline{O_1M})^2} - \overline{MN} =$$

$$\sqrt{(dk_1/2)^2 - (dg_1/2)^2} + \sqrt{(dk_2/2)^2 - (dg_2/2)^2} - a\sin\alpha b$$

$$t_e = (dg\lambda)/z = \pi m \cos\alpha_b$$

Normal pitch (te): a distance between the tooth surfaces measured at right angles to the tooth surfaces $$\therefore \epsilon = \{\sqrt{(dk_1/2)^2 - (dg_1/2)^2} + \sqrt{(dk_2/2)^2 - (dg_2/2)^2} - a\sin\alpha b\}/te \quad (2)$$

($\alpha b$ expresses the engagement pressure angle)

(With respect to respective designations, see FIGS. 4, 5 and the description from line 19 of page 2 to line 8 of page 3 in the specification. For example $\overline{ST}$ represents the length of the line connecting points S and T in FIG. 5, $\overline{MN}$ represents the length of the line connecting points M and N, etc.)

From the equation (2) of the numerical representation 1, it is found that the engagement coefficient $\epsilon$ is great when the engagement pressure angle $\alpha b$ is small, and it is small when $\alpha b$ is great.

In general, the number of the teeth of a ring gear employed in an engine is of the order of 100 and the number of the teeth of a pinion in the engine is of the order of 8 to 10. When only the pinion and ring gear are employed, the shift of the ring gear is set small and the shift of the pinion is set large, thereby balancing the strength of the teeth. Also, since the engagement pressure angle $\alpha b$ can be obtained according to the above-mentioned equation (1), a shift on one side is small and a shift on the other side is great, so that the denominator 2a (a: center distance) of the equation (1) does not become too large. Therefore, the engagement pressure angle $\alpha b$ does not become too large but provides a suitable value. As a result of this, a relatively large engagement coefficient can be obtained. Assuming that the intermediate gear 19 is not changed, if the above-mentioned relation is maintained between the intermediate gear 19 and ring gear 25, been both of the intermediate gear 19 and ring gear 25 provide large shifts to increase the denominator 2a, with the result that the engagement pressure angle $\alpha b$ also becomes large. In other words, while the engagement pressure angle $\alpha b$ between the intermediate gear 19 and ring gear 25 is small and the engagement coefficient thereof is large, the engagement pressure angle between the pinion 13 and the intermediate gear 19, is large and the engagement coefficient thereof is small.

In the above-mentioned conventional starter motor with an intermediate gear, a force acting on the intermediate gear 19 operates in such a manner that the engagement pressure angle between the pinion 13 and intermediate gear 19 is considerably larger than the engagement pressure angle between the intermediate gear 19 and ring gear 25. For this reason, the radial loads of these two engagement pressure angles are not balanced with each other, whereby the intermediate gear 19 is caused to come nearer by the clearance with respect to the intermediate gear shaft 18. As a result of this, an expected engagement cannot be obtained. For example, a backlash is large on one side while it is small on the other side, with the result that there can be produced a strange sound and a bearing (sleeve bearing) 20 of the intermediate gear 19 can be worn too excessively. Also, as described above, due to the fact that engagement coefficient between the pinion 13 and intermediate gear 19 is lowered, the teeth thereof are worn to a greater extent.

SUMMARY OF THE INVENTION

The present invention aims at eliminating the above-mentioned drawbacks found in the conventional starter motor with an intermediate gear. Accordingly, it is an object of the invention to provide a starter motor with an intermediate gear which can secure a good engaging performance for a pinion, an intermediate gear and a ring gear to thereby eliminate the strange sound of the intermediate gear and to reduce the wear of a bearing of the intermediate gear as well as the wear of the teeth of the pinion and intermediate gear.

To achieve the above object, according to the invention, there is provided a starter motor with an intermediate gear in which the shift coefficient of a pinion is set smaller than the shift coefficient of the intermediate gear, to thereby reduce a difference between two engagement pressure angles respectively obtained between the pinion and intermediate gear and between the intermediate gear and a ring gear.

According to the invention, due to the fact that the shift of a pinion having a smaller number of teeth is small, the mechanical strengths of the respective teeth are lowered. However the engagement coefficient thereof is enhanced to make up for the lowered mechanical strengths of the teeth. Also, due to the fact that the teeth number ratio of the intermediate to the pinion gear is set to be 2 or less in view of sliding of the teeth, for example, when compared with a starter motor with no intermediate gear included in which the teeth number ratio of a ring to a pinion gear is 10, the strength of the whole starter motor is not lowered while the degree of wear of the teeth of the gears is not increased.

DETAILED DESCRIPTION OF THE EMBODIMENT

Figure 1:
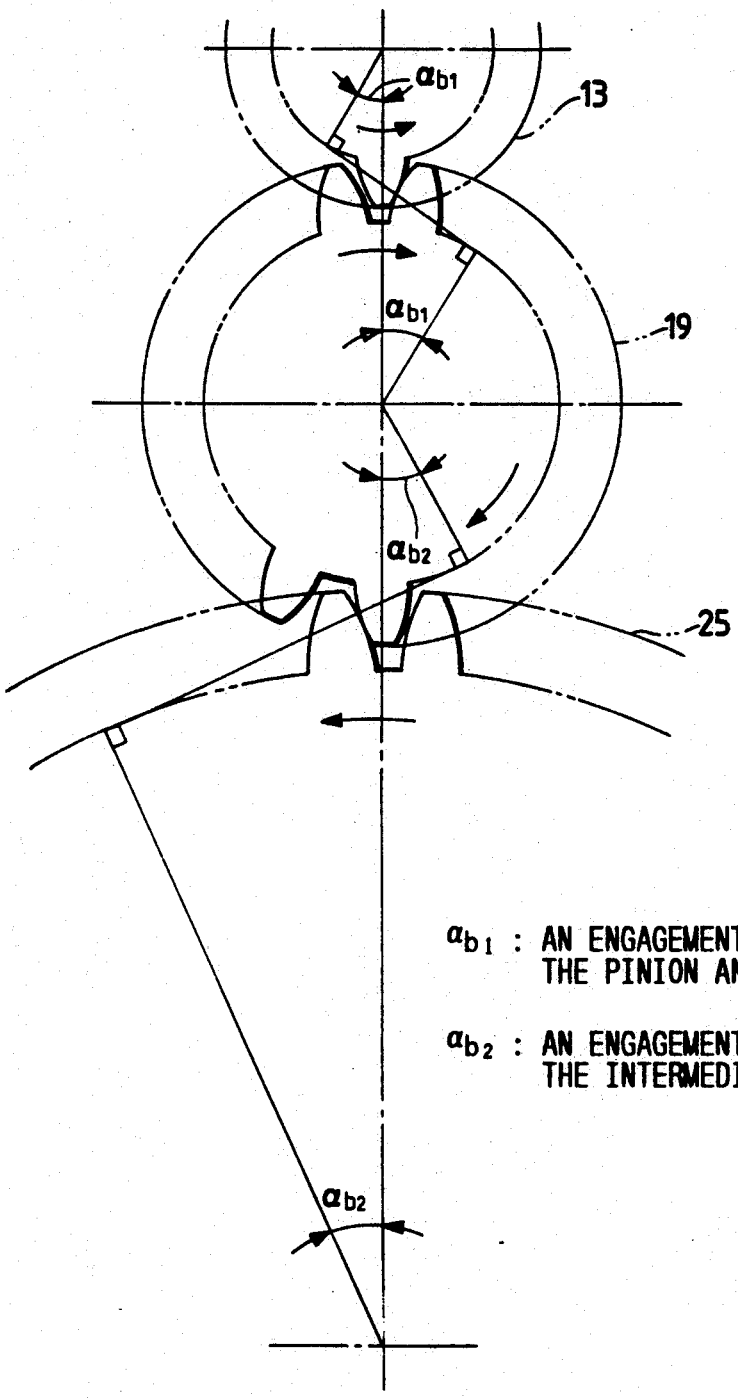
FIG. 1 is an explanatory view to show engagement relations respectively between a pinion, an intermediate gear and a ring gear employed in an embodiment of a starter motor with an intermediate gear according to the invention.
Figure 2:
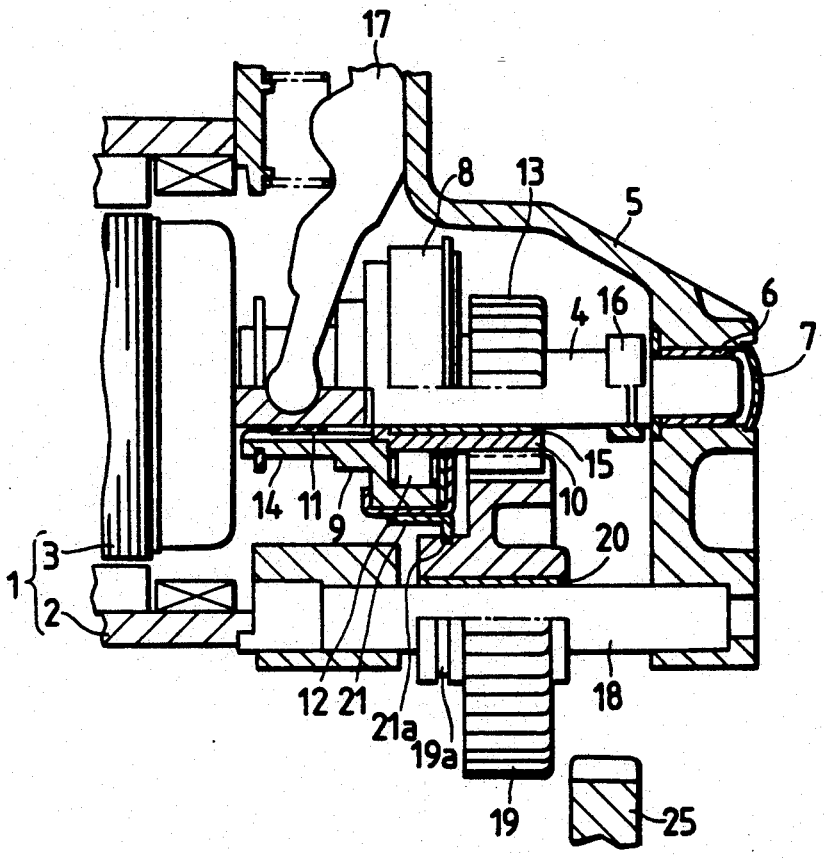
FIG. 2 is a longitudinal section view of main portions of an example of a starter motor with an intermediate gear which is applied to the embodiment according to the invention as well as a conventional starter motor with an intermediate gear.
Figure 3A:
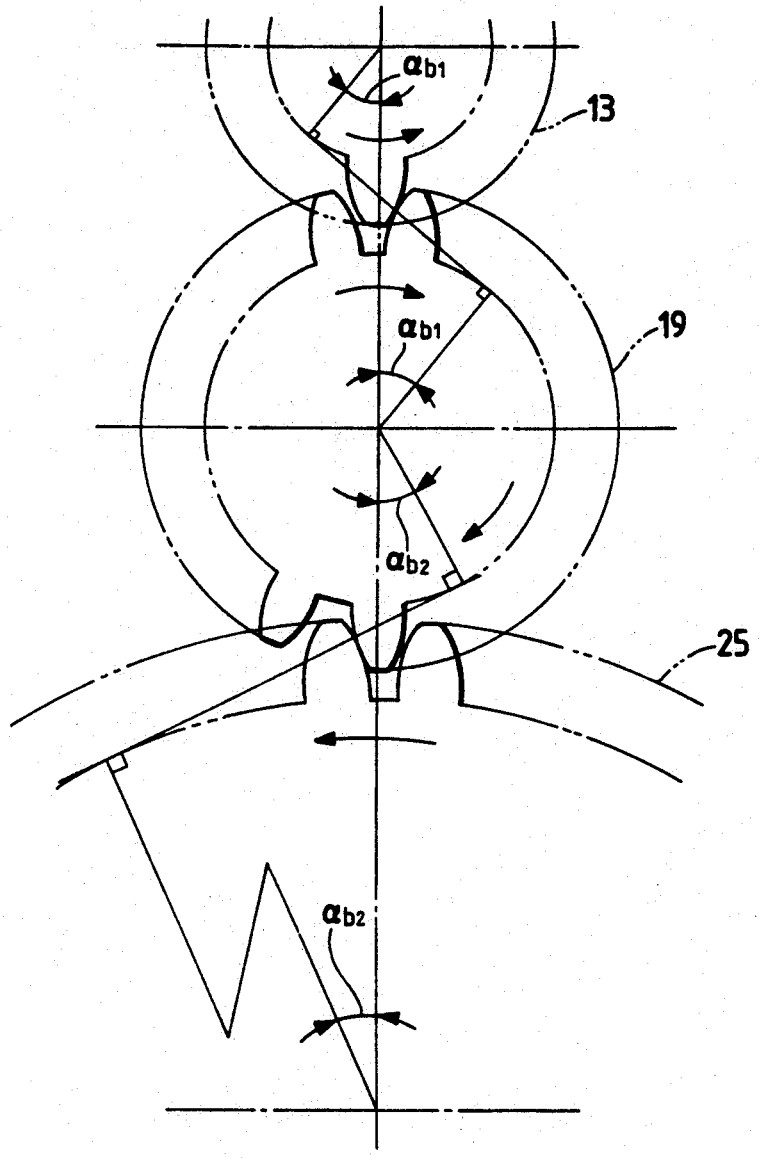
FIG. 3(A) is an explanatory view to show engagement relations respectively between a pinion, an intermediate gear and a ring gear employed in a conventional starter motor with an intermediate gear.
Figure 3B:
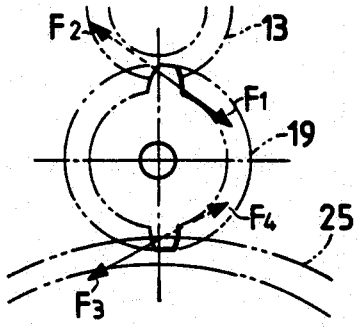
FIG. 3(B) is an explanatory view to show a relation between forces acting on the intermediate gear.
Figure 3C:
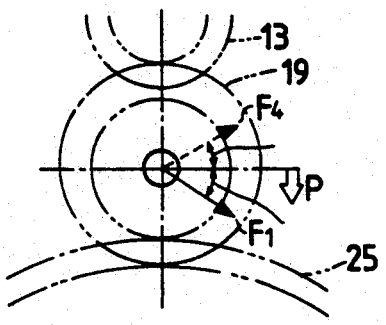
FIG. 3(C) is an explanatory view to show a composite force which is produced from the forces acting on the intermediate gear and acts on an intermediate gear shaft.
Figure 4:
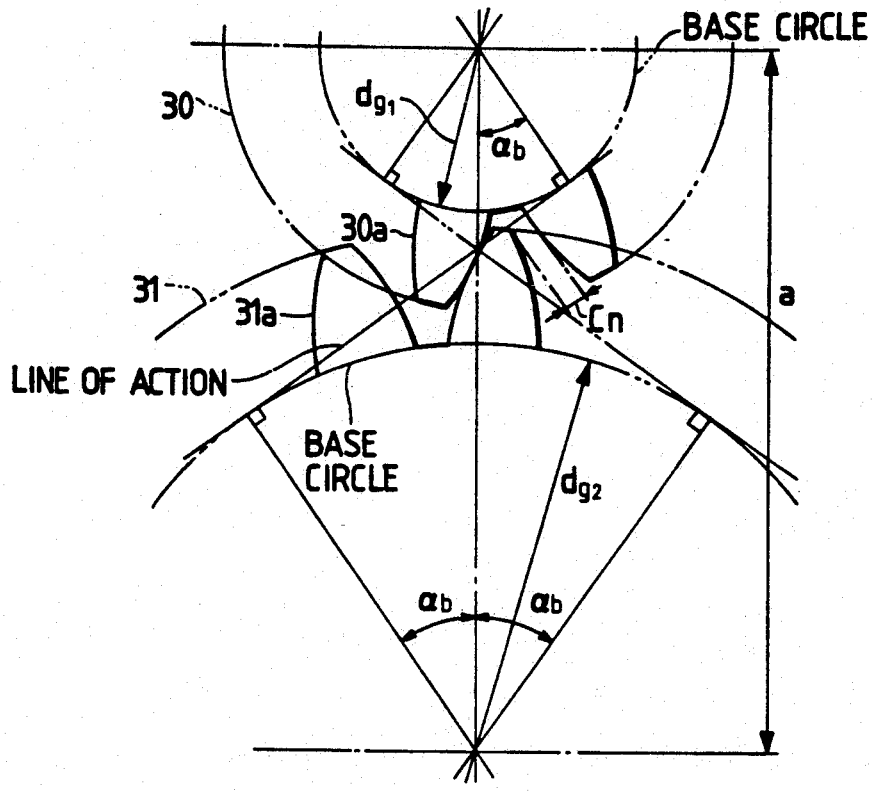
FIG. 4 is an explanatory view to show the engagement and shift between a small gear and a large gear; and, FIG. 5 is an explanatory view to show a relation between engagement coefficients given by a pair of gears.
Figure 5:
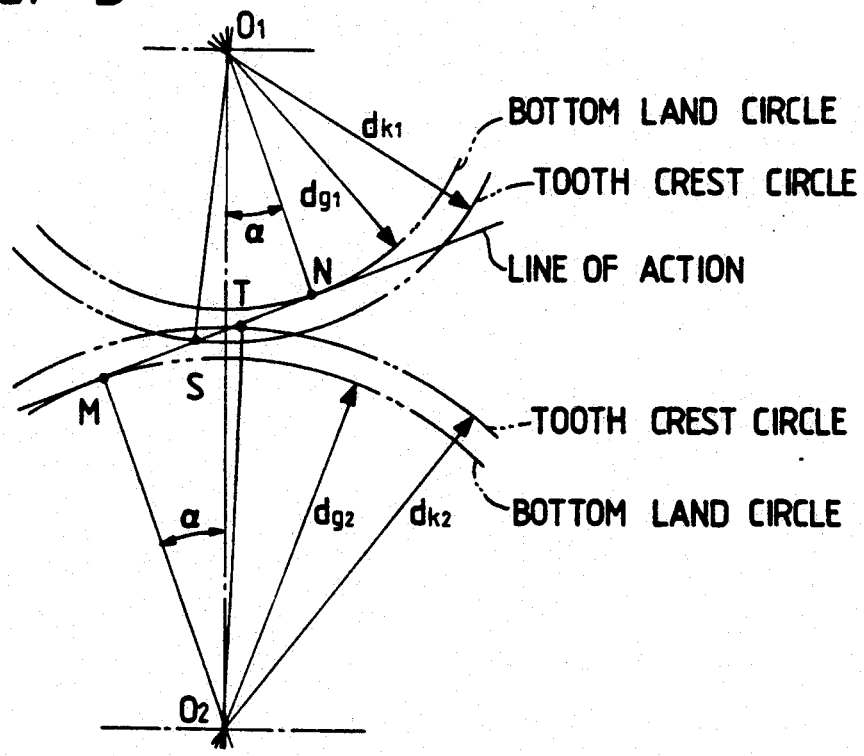

Referring now to an embodiment of a starter motor with an intermediate gear according to the invention, the structure of the embodiment is similar to that shown in FIG. 2. However, the present embodiment is improved in the engagement relations respectively between a pinion, an intermediate gear and a ring gear. This improvement will be described below with reference to FIG. 1. In FIG. 1, $\alpha b_1$ represents an engagement pressure angle between the pinion 13 and intermediate gear 19, and $\alpha b_2$ stands for an engagement pressure angle between the intermediate gear 19 and ring gear 25. The shift coefficient of the pinion 13 is set smaller than that of the intermediate gear 19. This reduces a difference between the two engagement pressure angles respectively obtained between the pinion 13 and intermediate gear 19 and between the intermediate gear 19 and ring gear 25. Therefore, a force acting on the intermediate gear 19 to bias the same with respect to the intermediate gear shaft 18 can be decreased and at the same time the engagement coefficient can be improved. This can keep a smooth engagement and can reduce the degree of wear of the bearing 20 and the possibility of generation of strange sounds caused by the engagement of the gear teeth with each other. Also, the teeth number ratio of the intermediate to the pinion gear is set to be 2 or less, which is preferable from the viewpoint of sliding of the gear teeth.

As has been described heretofore, according to the invention, the shift coefficient of a pinion is set smaller than that of an intermediate gear, which minimizes a difference between the two engagement pressure angles respectively obtained between the pinion and intermediate gear and between the intermediate gear and ring gear. This reduces the force to bias the intermediate gear toward an intermediate gear shaft, improves the engagement coefficient thereof to thereby be able to keep a smooth engagement, reduces the possibility of generation of strange sounds as well as the degree of wear of the bearing of the intermediate gear, and improves the reliability of the starter motor with an intermediate gear.

While the present invention has been described above with respect to preferred embodiments thereof, it should of course be understood that the present invention should not be limited only to these embodiments but various changes or modifications may be made without departure from the scope of the invention as defined by the appended claims.

What is claimed is:

1. An intermediate gear type starter motor comprising:

an output shaft extended integrally or connected to and extended from a front portion of a rotary shaft of a motor;

an overrunning clutch connected axially movably to the output shaft by means of a helical spline for transmitting rotation in one way;

a pinion, which is a profile shifted gear, provided in the front end portion of a clutch inner member of the overrunning clutch, an intermediate gear shaft mounted to or supported by a front bracket of the motor; and an intermediate gear, which is another profile shifted gear, supported through a bearing by the intermediate gear shift, the intermediate gear being always in engagement with the pinion, being movable through linking means by the axial movement of the overrunning clutch, and being engagable with a ring gear of an engine when moved forwardly to thereby transmit reduced rotation thereto;

wherein the shift coefficient of said pinion is set smaller than that of said intermediate gear to thereby be able to minimize a difference between two engagement pressure angles respectively obtained between said pinion and intermediate gear and between said intermediate gear and ring gear.

2. An intermediate gear type starter motor according to claim 1 in which the teeth number ratio of said intermediate gear to said pinion is set to be 2 or less.

* * * * *